US009273678B2

(12) United States Patent
Bonnefoi et al.

(10) Patent No.: US 9,273,678 B2
(45) Date of Patent: Mar. 1, 2016

(54) COMPRESSION DEVICE, AND THERMODYNAMIC SYSTEM COMPRISING SUCH A COMPRESSION DEVICE

(71) Applicant: DANFOSS COMMERCIAL COMPRESSORS, Trevoux (FR)

(72) Inventors: Patrice Bonnefoi, Saint Didier au Mont d'Or (FR); Kongkham Lo Van, Les Echets (FR); Alexandre Landre, Fontaines sur Saone (FR); David Genevois, Caillous sur Fontaine (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 259 days.

(21) Appl. No.: 13/916,161

(22) Filed: Jun. 12, 2013

(65) Prior Publication Data

US 2013/0330210 A1 Dec. 12, 2013

(30) Foreign Application Priority Data

Jun. 12, 2012 (FR) ..... 12 55460

(51) Int. Cl.
*F04B 41/06* (2006.01)
*F04B 23/04* (2006.01)
(Continued)

(52) U.S. Cl.
CPC ..... *F04B 23/04* (2013.01); *F04B 39/0207* (2013.01); *F04B 39/121* (2013.01);
(Continued)

(58) Field of Classification Search
CPC ..... F25B 2400/075; F25B 31/002; F25B 31/004; F04B 2700/03; F04B 39/0207; F04B 39/0284; F04B 39/121; F04B 23/04; F04B 49/02; F04B 41/06; F16N 19/006; F04C 2270/24; F04C 29/028; F04C 28/02; F04C 28/065
USPC ..... 417/12, 13, 228; 62/84, 192
See application file for complete search history.

(56) References Cited

U.S. PATENT DOCUMENTS 2,076,332 A * 4/1937 Zercher ..... F25B 31/002 184/6
3,140,041 A * 7/1964 Israel Kramer et al. ..... 417/338
(Continued)

FOREIGN PATENT DOCUMENTS

EP 2 177 760 A1 4/2010
EP 2 202 384 A1 6/2010
(Continued)

OTHER PUBLICATIONS

Oct. 4, 2012 Preliminary Search Report issued in French Patent Application No. FR 1255460.

*Primary Examiner* — Devon Kramer
*Assistant Examiner* — Nathan Zollinger
(74) *Attorney, Agent, or Firm* — Oliff PLC

(57) ABSTRACT

The compression device according to the invention includes first and second compressors mounted in parallel and an oil level equalization line arranged to fluidly connect the oil sumps of the first and second compressors. The oil level equalization line includes at least one oil level regulating portion positioned near one of the first and second compressors and including a dam wall extending transversely to the longitudinal direction of said oil level regulating portion and a flow opening arranged such that, when the oil level in the oil sump of the compressor situated near the oil level regulating portion extends above the upper level of the dam wall, oil flows through the flow opening toward the other compressor.

15 Claims, 4 Drawing Sheets

(51) Int. Cl.

| | |
|---|---|
| ***F04C 23/00*** | (2006.01) |
| ***F04B 39/02*** | (2006.01) |
| ***F04B 39/12*** | (2006.01) |
| ***F04B 49/02*** | (2006.01) |
| ***F25B 31/00*** | (2006.01) |
| ***F04C 29/02*** | (2006.01) |
| *F04C 28/02* | (2006.01) |
| *F04C 28/06* | (2006.01) |

(52) U.S. Cl.

CPC ..... *F04B 41/06* (2013.01); *F04B 49/02* (2013.01); *F04C 23/001* (2013.01); *F04C 23/008* (2013.01); *F04C 29/028* (2013.01); *F25B 31/004* (2013.01); *F04C 28/02* (2013.01); *F04C 28/065* (2013.01); *F04C 2240/806* (2013.01); *F04C 2240/809* (2013.01); *F25B 2400/075* (2013.01)

(56) References Cited

U.S. PATENT DOCUMENTS

| | | | | |
|---|---|---|---|---|
| 3,386,262 | A * | 6/1968 | Hackbart | F25B 1/00 62/469 |
| 3,581,519 | A * | 6/1971 | Garrett, Jr. et al. | 62/468 |
| 4,383,802 | A * | 5/1983 | Gianni et al. | 417/12 |
| 4,750,337 | A * | 6/1988 | Glamm | F04B 39/0207 62/468 |
| 5,586,450 | A | 12/1996 | Tollar et al. | |
| 8,398,387 | B2 * | 3/2013 | Shiotani | F01C 11/004 418/5 |
| 2009/0277213 | A1 * | 11/2009 | Sakitani | F25B 9/06 62/470 |
| 2010/0186433 | A1 | 7/2010 | Galante et al. | |

FOREIGN PATENT DOCUMENTS

| | | | |
|---|---|---|---|
| JP | U-6-46261 | | 6/1994 |
| JP | 2008286151 | A * | 11/2008 |

* cited by examiner

COMPRESSION DEVICE, AND THERMODYNAMIC SYSTEM COMPRISING SUCH A COMPRESSION DEVICE

The present invention relates to a compression device, and a thermodynamic system comprising such a compression device.

In a known manner, a thermodynamic system, and more particularly a refrigeration system, comprises a refrigerant circulation circuit successively including a condenser, an expander, an evaporator and a compression device connected in series.

The compression device of such a thermodynamic system generally comprises:

- at least one first compressor and one second compressor mounted in parallel, each compressor comprising an enclosure in particular including a low-pressure part containing a motor and an oil sump positioned in the bottom of the enclosure, and a high-pressure part including a compression stage,
- a suction line connected to the evaporator,
- a first suction pipe putting the suction line in communication with the intake port of the first compressor, and
- a second suction pipe putting the suction line in communication with the intake port of the second compressor.

In order to ensure proper operation and good reliability of such a refrigeration system, it is necessary to balance the oil levels in the oil sumps of the two compressors.

Such balancing of the oil levels is for example obtained by positioning a restricting member in one of the first and second suction pipes so as to limit the pressure deviation between the low-pressure parts of the two compressors during operating conditions thereof and to connect the oil sumps of the two compressors by means of an oil level equalization line favoring the transfer of oil between the two compressors.

As a result, during operating conditions of the two compressors, the excess oil contained in the oil sump of one of the compressors is driven toward the oil sump of the other compressor, by means of the oil level equalization pump, so as to balance the oil levels in the first and second compressors.

One drawback of this type of compression device lies in the fact that the restricting member positioned in one of the first and second suction pipes in no way makes it possible to ensure equalization of the pressures in the low-pressure parts of the compressors, or at least to keep the pressure deviation low between the low-pressure parts of two compressors, irrespective of the operating conditions of the compressors, and in particular when one of the compressors is stopped. Such a drawback is in particular due to the fact that the pressure losses of the suction pipes, the equalization pipe and the restricting member are related to the speed profiles of the refrigerant in each suction pipe, and therefore the fact that significant variations in the input conditions of the refrigerant in each bypass pipe may significantly modify the behavior of the restricting member.

In particular, when the compression device of the aforementioned type operates with one of the compressors stopped, the pressure in the low-pressure part of the stopped compressor increases considerably, which causes oil contained in the oil sump of the stopped compressor to flow toward the other compressor until the oil level in the stopped compressor drops to a level lower than the opening of the pressure equalization line emerging in the stopped compressor.

Further, when the compression device of the aforementioned type operates with one of the compressors stopped, the flow speed of the refrigerant inside the low-pressure part of the stopped compressor remains high. This results in significant foaming of the oil contained in the oil sump of the stopped compressor and the trapping of many oil droplets in the refrigerant. This refrigerant, highly charged with oil, flows toward the other compressor by means of the oil level equalization line, which causes a significant drop in the oil level in the oil sump of the stopped compressor, well below the lower level of the opening of the pressure equalization line emerging in the stopped compressor. Thus, when the compressor is subsequently restarted, the quantity of oil contained in the oil sump thereof may not be sufficient to ensure suitable lubrication of the different moving parts of the compressor, which can damage the integrity of the compressor.

The present invention aims to resolve these drawbacks.

The technical problem at the base of the invention therefore consists of providing a compression device that has a simple, cost-effective and reliable structure, while making it possible to obtain satisfactory balancing of the oil levels in each compressor irrespective of the operating conditions of the compression device, and irrespective of the type of compressors used.

To that end, the present invention relates to a compression device comprising:

- at least one first and one second compressor mounted in parallel and each comprising a sealed enclosure containing a motor, an oil sump and a drive shaft rotatably coupled to the motor and including a lubrication duct designed to be supplied with oil from oil contained in the oil sump, and
- an oil level equalization line arranged to fluidly connect the oil sumps of the first and second compressors, characterized in that the oil level equalization line comprises at least one oil level regulating portion positioned near one of the first and second compressors, the oil level regulating portion including a dam wall extending transversely to the longitudinal direction of said oil level regulating portion and a flow opening arranged such that, when the oil level in the oil sump of the compressor situated near the oil level regulating portion extends above the upper level of the dam wall, oil flows through the flow opening toward the other compressor, and in that the oil level equalization line is arranged and sized such that an upper portion of the flow section of the equalization line is designed to transfer refrigerant between the first and second compressors, and a lower portion of the flow section of the equalization line is designed to transfer oil between the first and second compressors.

Such a configuration of the oil regulating portion, and in particular the dam wall, makes it possible, when the compressor positioned near the oil level regulating portion is stopped, to favor the suction, through the oil level equalization line and toward the other compressor, of refrigerant coming from the upper area of the low-pressure part of the stopped compressor and therefore less charged with oil. Thus, the oil level regulating portion makes it possible to greatly limit the discharge of oil droplets toward the opposite compressor, when the oil level in the oil sump of the compressor positioned near the oil level regulating portion extends below the upper level of the dam wall.

Consequently, the compression device according to the invention ensures the presence of a minimum quantity of oil in the oil sump of the compressor positioned near the oil level regulating portion, irrespective of the operating conditions of the compression device, and irrespective of the type of compressors used.

Further, such a configuration of the oil level regulating portion allows a flow of oil from the oil sump to the compressor positioned near the oil level regulating portion toward the other compressor when the quantity of oil in the compressor positioned near the level regulating portion exceeds a predetermined value. These arrangements make it possible to avoid storing an excessive quantity of oil in the compressor positioned near the oil level regulating portion.

Consequently, the compression device according to the invention makes it possible to regulate the quantity of oil in the oil sump of the compressor in which the oil level regulating portion protrudes in a predetermined value range.

Advantageously, the oil level regulating portion protrudes inside the sealed enclosure of one of the first and second compressors. These arrangements make it possible to limit lapping of the inner wall of the sealed enclosure of the corresponding compressor, which is generally covered with a film of oil, by the refrigerant flowing through the oil level regulating portion, and therefore to further limit the discharge of oil toward the opposite compressor.

According to one embodiment of the invention, the dam wall forms an end wall of the oil level regulating portion.

Advantageously, the oil level regulating portion is positioned at one of the ends of the oil level equalization line.

According to one embodiment of the invention, the dam wall forms an end wall of the oil level equalization line.

Preferably, the flow opening is formed above the dam wall.

According to one embodiment of the invention, the flow opening is inclined relative to the longitudinal direction of the oil level regulating portion. The flow opening for example forms an angle comprised between 0° and 87° relative to the longitudinal direction of the oil level regulating portion. These arrangements make it possible to further favor the suction, through the oil level equalization line and toward the other compressor, of refrigerant coming from the upper area of the low-pressure part of the compressor situated near the oil level regulating portion.

Preferably, the flow opening extends from the dam wall, and more particularly from the upper edge of the dam wall.

According to one embodiment of the invention, the oil level regulating portion includes a flow channel delimited at least partially by the dam wall, the flow channel being fluidly connected to the sealed enclosure of the compressor positioned near the flow opening.

Advantageously, the dam wall covers a lower portion of the passage cross-section of the flow channel of the oil level regulating portion.

Preferably, the oil level regulating portion includes a side wall, the side wall and the dam wall of the oil level regulating portion defining the flow channel.

According to one feature of the invention, the flow opening extends over a portion of the side wall of the oil level regulating portion.

Advantageously, the sealed enclosure of each compressor includes an equalization port emerging in the corresponding oil sump, and the oil level equalization line includes a tubular connecting portion arranged to fluidly connect the equalization ports of the first and second compressors, the tubular connecting portion being fluidly connected to the oil level regulating portion.

Preferably, the connecting portion has a substantially constant diameter.

According to a first alternative embodiment of the invention, the tubular connecting portion is formed by a connecting pipe comprising first and second ends respectively connected to the equalization ports of the first and second compressors, and the oil level regulating portion is formed by an oil level regulating element separate from the connecting pipe. These arrangements make it possible to facilitate the assembly of the oil level equalization line, and to use standard oil level equalization lines as connecting pipes.

Advantageously, the oil level regulating element includes a mounting part connected to the equalization port of the corresponding compressor.

According to a second alternative embodiment of the invention, the oil level regulating portion and the connecting portion are formed by an equalization pipe.

According to one embodiment of the invention, the passage cross-section of the flow opening is larger than one third of the passage cross-section of the connecting portion. These arrangements make it possible to prevent deterioration of the pressure equalization quality achieved by means of the oil level equalization line.

According to one embodiment of the invention, the oil level regulating portion includes a tubular part. Preferably, the diameter of the tubular part of the oil level regulating portion is comprised between 0.75 times the diameter of the connecting portion and 1.25 times the diameter of the connecting portion. According to one embodiment of the invention, the passage cross-section of the tubular part of the oil level regulating portion is larger than 0.5 times the passage cross-section of the connecting portion, and preferably smaller than 1.5 times the passage cross-section of the connecting portion. These arrangements also make it possible to avoid deterioration of the quality of the pressure equalization done by means of the oil level equalization line.

Preferably, the oil level regulating portion includes an oil return port situated below the upper level of the dam wall of the oil level regulating portion. The oil return port is fluidly connected to the sealed enclosure of the compressor positioned near the oil level regulating portion, and preferably emerges in the sealed enclosure of said compressor.

Advantageously, the oil return port is formed on the dam wall of the oil level regulating portion.

According to one embodiment of the invention, the oil return port has a passage cross-section comprised between 1/250 and 1/10 of the passage cross-section of the connecting portion. These arrangements make it possible on the one hand to ensure a sufficient oil flow rate through the oil return port, and therefore to avoid an accumulation of oil in the equalization line, and on the other hand to limit a flow of refrigerant highly charged with oil toward the other compressor, and therefore to ensure a satisfactory oil level in the compressor situated near the oil level regulating portion.

According to one embodiment of the invention, each compressor comprises viewing means arranged to make it possible to view the oil level in the oil sump of said compressor through the sealed enclosure thereof, and at least one portion of the oil return port of the oil level regulating portion extends substantially at the same level as the viewing means belonging to the compressor positioned near the oil level regulating portion. These arrangements make it possible to keep the oil level in the compressor positioned near the oil level regulating portion substantially at the level of the viewing means. According to one embodiment of the invention, at least one lower portion of the oil return port of the oil level regulating portion extends substantially at the same level as the viewing means belonging to the compressor positioned near the oil level regulating portion. According to another embodiment of the invention, the entire oil return port of the oil level regulating portion extends at the same level as the viewing means belonging to the compressor positioned near the oil level regulating portion.

Preferably, the viewing means include a viewing window positioned on the wall of the sealed enclosure of the corresponding compressor. Advantageously, at least one portion of the oil return port of the oil level regulating portion extends substantially at the same level as the viewing window.

According to another embodiment of the invention, the oil level equalization line comprises viewing means arranged to make it possible to view the oil level in the oil level equalization line, and the oil return port of the oil level regulating portion extends substantially at the same level as the viewing means belonging to the oil level equalization line.

According to one embodiment of the invention, the drive shaft of each compressor comprises at least one lubrication port respectively emerging on the one hand in the lubrication duct and on the other hand in the outer surface of the drive shaft. Each lubrication port is advantageously positioned at a guide bearing of the drive shaft.

According to one embodiment of the invention, each compressor comprises oil supply means arranged to supply the lubrication duct of the corresponding drive shaft with oil, the oil supply means comprising an oil input port designed to be connected to the corresponding oil sump and an oil output port connected to the lubrication duct of the drive shaft.

Preferably, the oil return port of the oil level regulating portion extends above the oil input port of the supply means belonging to the compressor positioned near the oil level regulating portion. These arrangements make it possible to keep the oil level in the compressor positioned near the oil level regulating portion above the oil input port of the corresponding supply means, and therefore to avoid un-priming of the oil supply from the lubrication duct of the corresponding drive shaft.

Advantageously, the supply means belonging to each compressor comprise an oil pump rotated by the corresponding drive shaft, each oil pump comprising the corresponding oil input and oil output ports.

According to one embodiment of the invention, the sealed enclosure of each compressor includes an intake port emerging in a low-pressure part of said compressor, and the compression device comprises a suction line designed to be connected to an evaporator, a first suction pipe putting the suction line in communication with the intake port of the first compressor, and a second suction pipe putting the suction line in communication with the intake port of the second compressor.

Preferably, the diameter of the tubular part of the oil level regulating portion is comprised between 0.5 times the diameter of the first suction pipe and 1.5 times the diameter of the first suction pipe.

Advantageously, the passage cross-section of the tubular part of the oil level regulating portion is comprised between 0.25 times the passage cross-section of the first suction pipe and 2.25 times the passage cross-section of the first suction pipe.

According to one embodiment of the invention, the second suction pipe comprises restricting means arranged to reduce the flow cross-section of the refrigerant in the second suction pipe.

Advantageously, the restricting means are arranged such that the flow cross-section of the refrigerant at the restricting means is smaller than the flow cross-section of the refrigerant at the intake port of the second compressor.

According to one embodiment of the invention, the restricting means are arranged to maintain a pressure in the low-pressure part of the first compressor that is higher than the pressure in the low-pressure part of the second compressor when the first and second compressors operate simultaneously. In such an embodiment, when the oil level regulating portion is positioned near the first compressor, the dam wall ensures the presence of a minimum quantity of oil in the oil sump of the first compressor despite the fact that the low-pressure part thereof has an overpressure.

According to one embodiment of the invention, the first compressor is a variable-capacity compressor, and the second compressor is a fixed-capacity compressor.

According to another embodiment of the invention, the first and second compressors are fixed-capacity compressors. The first and second fixed-capacity compressors may for example have different capacities.

According to one embodiment of the invention, the oil level regulating portion protrudes inside the sealed enclosure of the first compressor.

According to another embodiment of the invention, the oil level equalization line includes first and second oil level regulating portions each positioned near one of the first and second compressors. Preferably, the first and second oil level regulating portions each protrude inside the sealed enclosure of one of the first and second compressors.

According to one embodiment, the compression device comprises a third compressor mounted in parallel with the first and second compressors, the oil level equalization line being arranged to fluidly connect the oil sumps of the first, second and third compressors. Advantageously, the oil level equalization line includes at least one first tubular bypass portion arranged to fluidly connect the tubular connecting portion to the equalization port of the third compressor.

According to one embodiment, the compression device comprises a fourth compressor mounted in parallel with the first, second and third compressors, the oil level equalization line being arranged to fluidly connect the oil sumps of the first, second, third and fourth compressors. Advantageously, the oil level equalization line includes a second tubular bypass portion arranged to fluidly connect the first tubular bypass portion to the equalization port of the fourth compressor.

According to one embodiment of the invention, the oil level equalization line includes an oil level regulating portion positioned near each compressor. Preferably, each of the oil level regulating portions protrudes inside the sealed enclosure of the corresponding compressor.

The present invention also relates to a thermodynamic system, comprising a refrigerant circulation circuit successively including a condenser, an expander, an evaporator and a compression device according to the invention connected in series.

The invention will be well understood using the following description provided in reference to the appended diagrammatic drawing showing, as non-limiting examples, two embodiments of this compression device.

Figure 1:
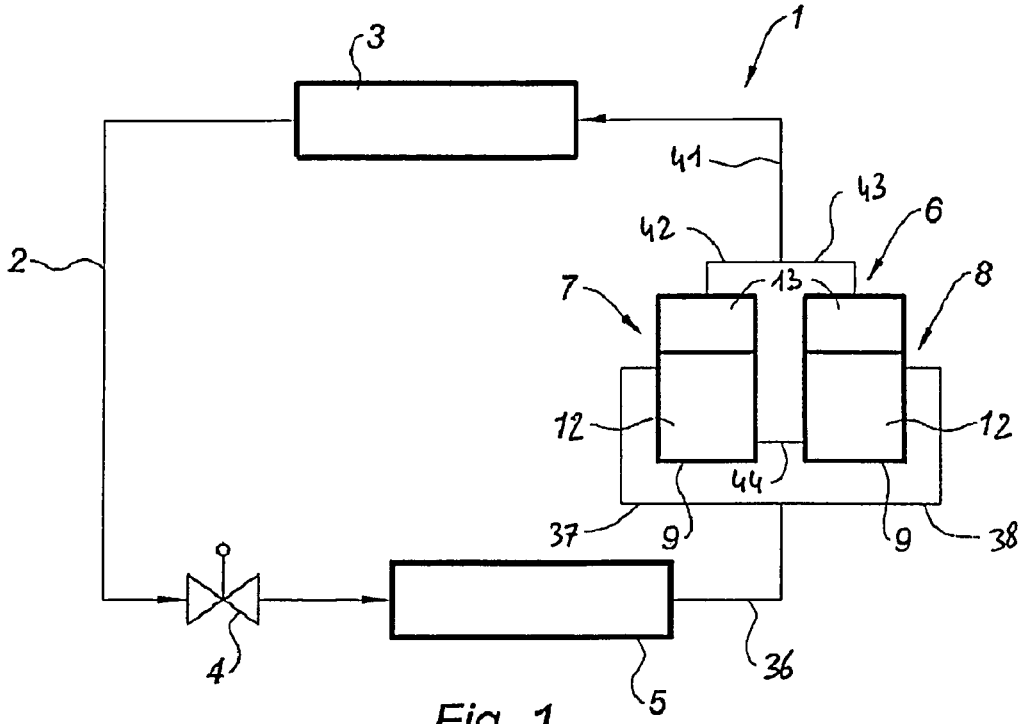
FIG. 1 is a diagrammatic view of a thermodynamic system according to the invention.
Figure 2:
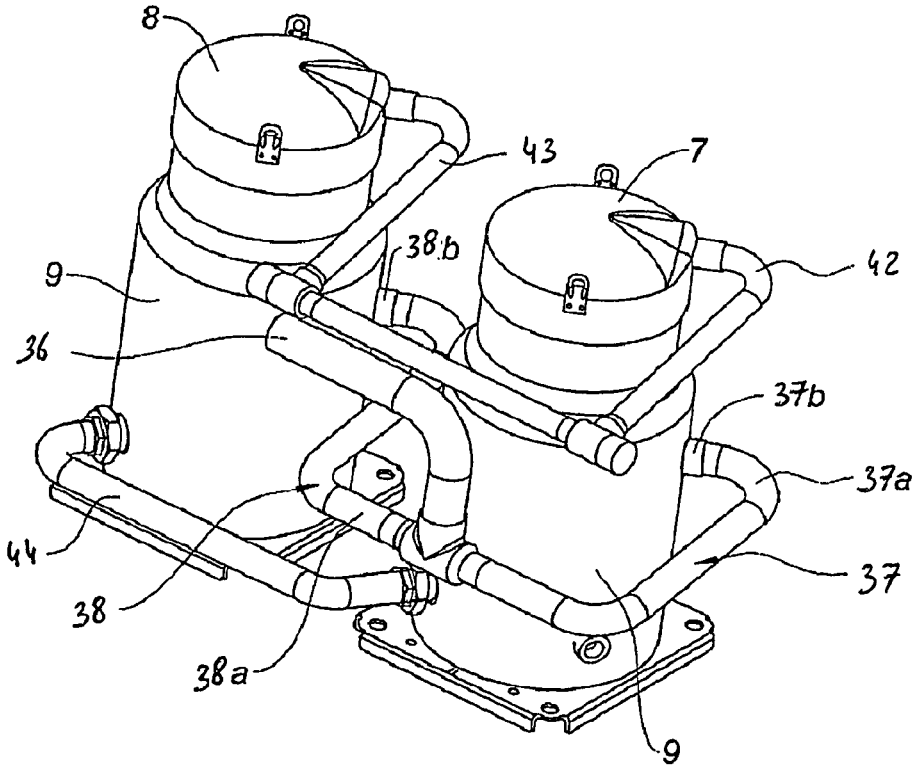
FIG. 2 is a perspective view of a first embodiment of a compression device belonging to the thermodynamic system of FIG. 1.

FIG. 1 diagrammatically shows the main components of a thermodynamic system 1. The thermodynamic system 1 may be a refrigeration system, such as a reversible refrigeration system.

The thermodynamic system 1 comprises a circulation circuit 2 for a refrigerant successively including a condenser 3, an expander 4, an evaporator 5 and a compression device 6 connected in series.

The compression device 6 comprises a first compressor 7 and a second compressor 8 mounted in parallel, each compressor being able to have a variable capacity, and more particularly a variable speed, or a fixed capacity, and more particularly a fixed speed. Each compressor 7, 8 is advantageously a scroll compressor.

Figure 4:
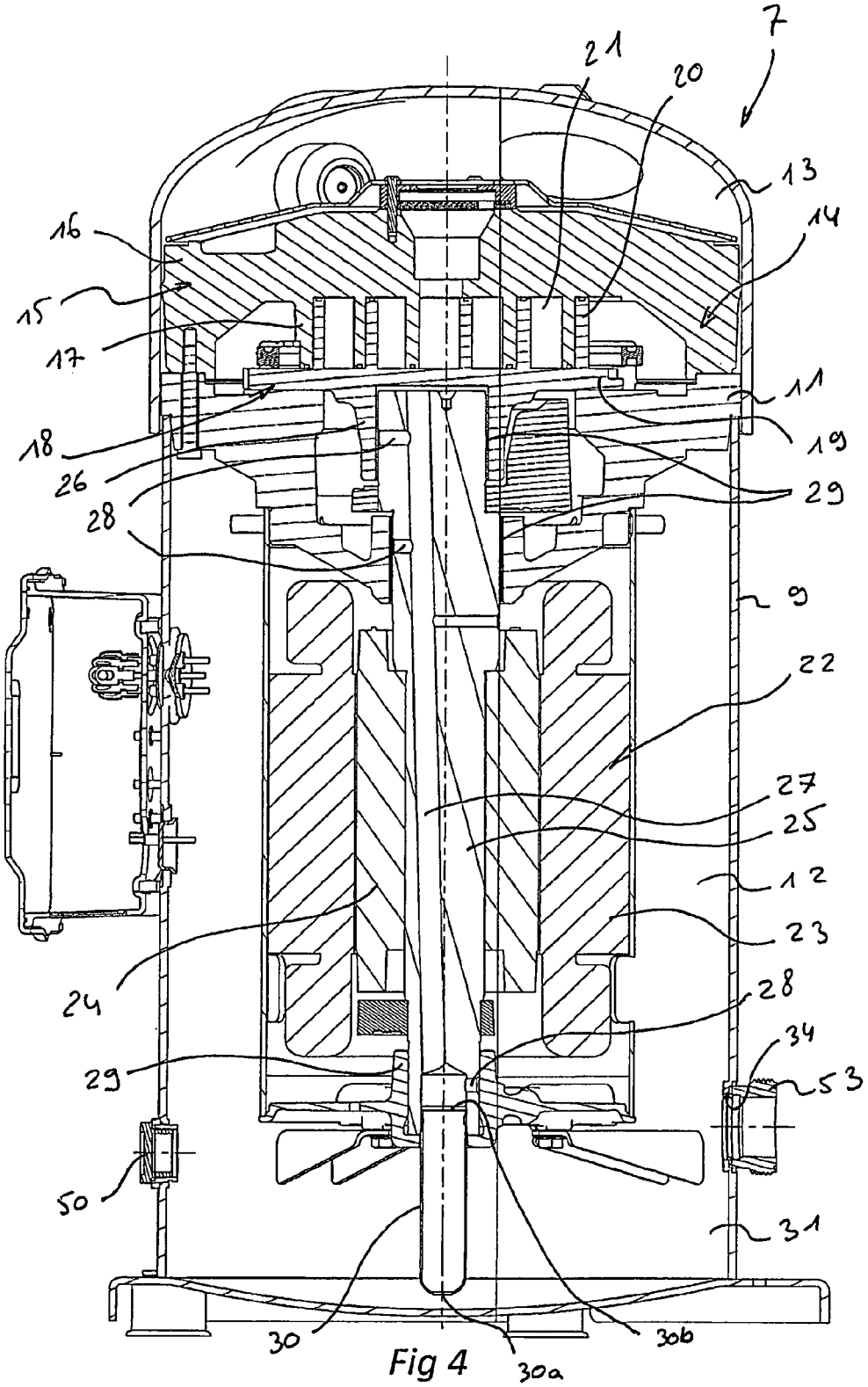
FIG. 4 is a longitudinal cross-sectional view of a compressor of the compression device of FIG. 2.

As illustrated in FIG. 4, each compressor 7, 8 comprises a sealed enclosure 9 in which a body 11 is mounted that delimits a low-pressure part 12 situated below the body 11 and a high-pressure part 13 situated above the body 11.

Each compressor 7, 8 includes a compression stage 14. This compression stage 14 includes a fixed scroll 15 including a plate 16 from which a fixed wrap 17 extends turned downward, and a moving scroll 18 including a plate 19 bearing against the body 11 and from which a wrap 20 extends turned upward. The two wraps 17 and 20 of the two scrolls engage with one another to form variable-volume compression chambers 21.

Each compressor 7, 8 also comprises an electric motor 22 positioned in the low-pressure part 12 thereof and provided with a stator 23 at the center of which a rotor 24 is positioned. The rotor 24 is secured to a drive shaft 25 whereof the upper end is off-centered like a crankshaft. This upper part is engaged in a sleeve 26 provided on the moving scroll 18. Thus, when it is rotated by the motor 22, the drive shaft 25 drives the moving scroll 18 in an orbital movement.

The drive shaft 25 comprises a lubrication duct 27 formed in its central part. The lubrication duct 27 is off-centered and preferably extends over the entire length of the drive shaft 25. The drive shaft 25 also comprises a plurality of lubrication ports 28 respectively emerging on the one hand in the lubrication duct 27 and on the other hand in the outer surface of the drive shaft 25. Each lubrication port 28 is advantageously positioned at a bearing 29 of the drive shaft 25.

Each compressor 7, 8 also comprises an oil pump 30 housed in the low-pressure part 12 of the sealed enclosure 9. The oil pump 30 is rotatably coupled to the lower end of the drive shaft 25, and is arranged to supply the lubrication duct 27 with oil from the oil contained in an oil sump 31 positioned in the bottom of the sealed enclosure 9.

The compression device 6 also comprises control means 32 arranged to selectively control the respective switching of the first and second compressors 7, 8 between a running mode and a stopped mode, the running mode optionally being able to be controlled between a minimum speed and a maximum speed.

The sealed enclosure 9 of each compressor 7, 8 also includes a refrigerant intake port 33 emerging in an upper portion of the low-pressure part 12, an equalization port 34 emerging in the oil sump 31, and a discharge port 35 emerging in the high-pressure part 13.

The compression device 6 also comprises a suction line 36 connected to the evaporator 5, a first suction pipe 37 putting the suction line 36 in communication with the intake port 33 of the first compressor 7, and a second suction pipe 38 putting the suction line 36 in communication with the intake port 33 of the second compressor 8. Each suction pipe 37, 38 respectively comprises a suction tube 37*a*, 38*a* connected to the suction line 36 and a connecting sleeve 37*b*, 38*b* connected to the corresponding intake port 33.

Figure 3:
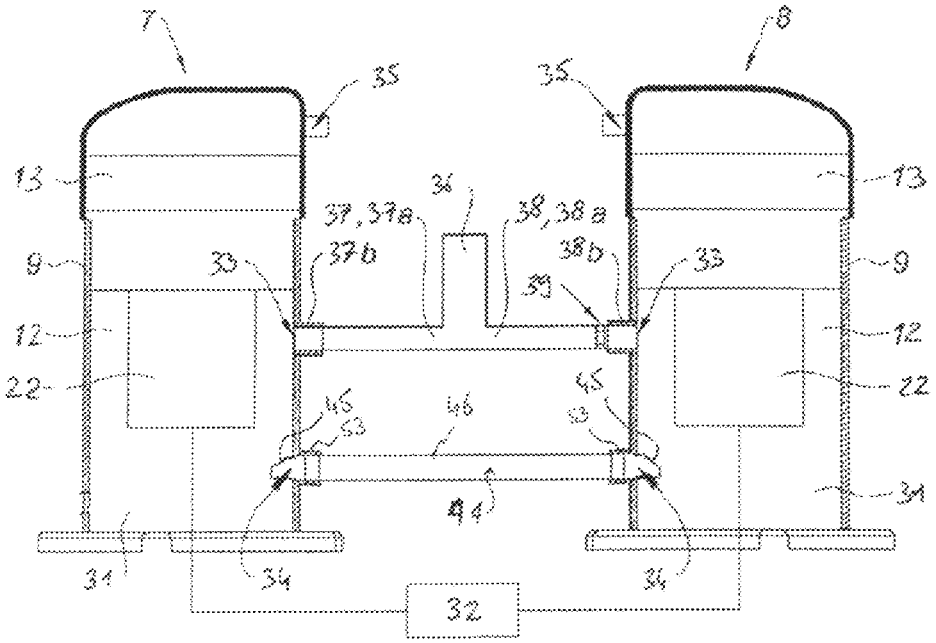
FIG. 3 is a diagrammatic cross-sectional view of the compression device of FIG. 2.

As shown in FIG. 3, the second suction pipe 38 comprises means for reducing the flow cross-section of the refrigerant in said suction pipe. The reducing means are arranged such that the flow cross-section of the refrigerant gas at the reducing means is smaller than the flow cross-section of the refrigerant gas at the intake port 33 of the second compressor 8. The reducing means are advantageously positioned near the intake port 33 of the second compressor 8.

The reducing means preferably comprise an annular ring 39 fixed in the second suction pipe 38, for example by brazing or crimping. The annular ring 39 includes a longitudinal through opening centered relative to the wall of the second suction pipe 38. It must be noted that the outer diameter of the annular ring 39 substantially corresponds to the inner diameter of the bypass tube 38*a* of the second suction pipe 38.

According to one alternative embodiment not shown in the figures, the annular ring 39 may be fixed in the connecting sleeve 38*b* of the second suction pipe 38.

The compression device 6 also comprises a discharge line 41 connected to the condenser 3, a first discharge pipe 42 putting the discharge line 41 in communication with the discharge port 35 of the first compressor 7, and a second discharge pipe 43 putting the discharge line 41 in communication with the discharge port 35 of the second compressor 8.

The compression device 6 also comprises an oil level equalization line 44 connecting the equalization ports 34 of the first and second compressors 7, 8 and thereby putting the oil sumps 31 of the first and second compressors in communication.

The oil level equalization line 44 includes an oil level regulating portion 45 at each of its ends, and a tubular connecting portion 46 extending between the two compressors and fluidly connecting the two oil level regulating portions 45.

Figure 5:
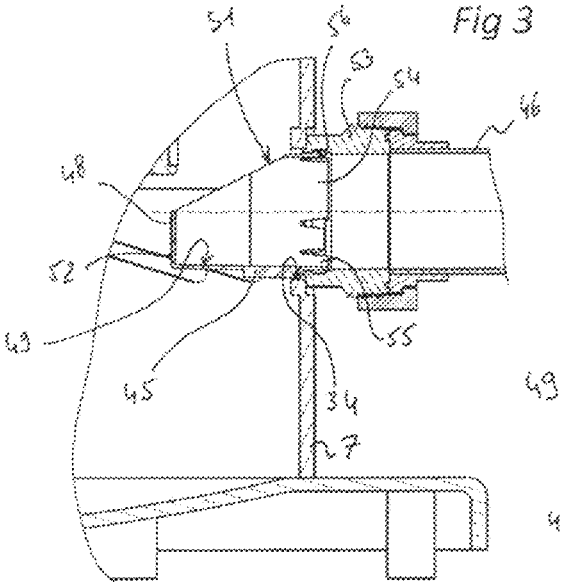
FIG. 5 is an enlarged partial cross-sectional view of the compression device of FIG. 2.
Figure 6:
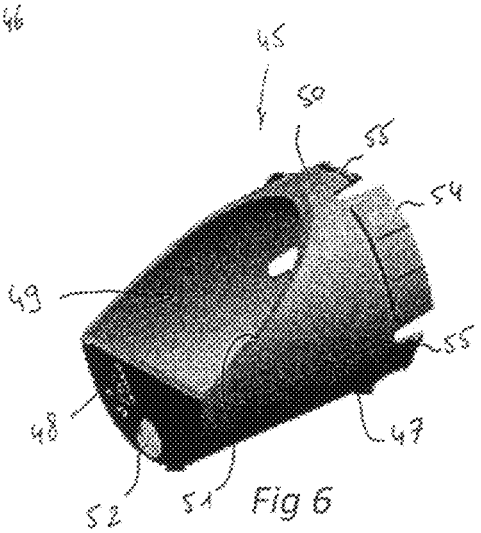
FIG. 6 is a perspective view of an oil level regulating element belonging to the compression device of FIG. 2.

Each oil level regulating portion 45 protrudes inside the enclosure 9 of one of the first and second compressors 7, 8. As shown in FIGS. 5 and 6, each oil level regulating portion 45 on the one hand includes a side wall 47 and a transverse dam wall 48 defining a flow channel 49 fluidly connected to the connecting portion 46, and on the other hand a flow opening 51 formed above the dam wall 48 and extending from the upper edge of the dam wall 48. The dam wall of each oil level regulating portion 45 forms an end wall of said oil level regulating portion 45, and advantageously covers a lower portion of the passage cross-section of the flow channel 49 of said oil level regulating portion 45. According to the embodiment shown in FIGS. 3 to 6, the dam walls of the two oil level regulating portions 45 form the end walls of the oil level equalization line 44.

Each oil level regulating portion 45 is configured such that, when the oil level in the oil sump 31 of the corresponding compressor extends above the upper edge of the end wall 48, oil flows through the flow opening 51 toward the other compressor.

Advantageously, each oil level regulating portion 45 includes a tubular portion 50. Preferably, the diameter of the tubular portion 50 of each oil level regulating portion 45 is comprised between 0.75 times the diameter of the connecting portion 46 and 1.25 times the diameter of the connecting portion 46. According to one embodiment of the invention, the passage cross-section of the tubular part 50 of each oil level regulating portion 45 is larger than 0.5 times the passage cross-section of the connecting portion 46, and preferably smaller than 1.5 times the passage cross-section of the connecting portion 46.

Each oil level regulating portion 45 also includes an oil return port 52 situated below the upper level of the dam wall 48 and emerging in the sealed enclosure 9 of the compressor in which said oil level regulating portion 45 protrudes. This position of each oil return port 52 makes it possible to avoid storing oil beyond a predetermined level inside the oil level equalization line 44, and ensures the return of oil coming from the other compressor.

Preferably, the oil pump 30 of each compressor 7, 8 comprises an oil intake port 30*a* designed to be connected to the corresponding oil sump 31 and an oil output port 30*b* connected to the lubrication duct 27 of the corresponding drive shaft 25. Advantageously, the oil return port 52 of each oil level regulating portion 45 extends above the oil input port 30*a* of the corresponding oil pump 30.

According to one alternative embodiment of the invention, the sump of the oil pump 30 may be made in a single piece with the drive shaft 25.

According to one alternative embodiment of the invention, each compressor 7, 8 comprises a viewing window 60 formed in the wall of the sealed enclosure 9 of said compressor and arranged to make it possible to view the oil level in the oil sump 31 of said compressor through the sealed enclosure 9. Advantageously, the oil return port 52 of each oil level regulating portion 45 extends substantially at the same level as the viewing window 60 of the corresponding compressor.

According to a first embodiment of the compression device 6 shown in FIGS. 3 to 6, the connecting portion 46 is formed by a connecting pipe comprising a first and second end respectively connected to connecting sleeves 53 secured to equalization ports 34 of the first and second compressors 7, 8. Further, according to this embodiment of the compression device 6, each oil level regulating portion 45 is in turn formed by an oil level regulating element separate from the connecting pipe. Each oil level regulating element advantageously includes an assembly part 54 extending through the corresponding equalization port 34 and arranged to cooperate with the corresponding connecting sleeve 53. Each assembly part 54 for example includes snap tabs 55 arranged to cooperate with an annular slot 56 formed in the inner wall of the corresponding connecting sleeve 53.

Figure 7:
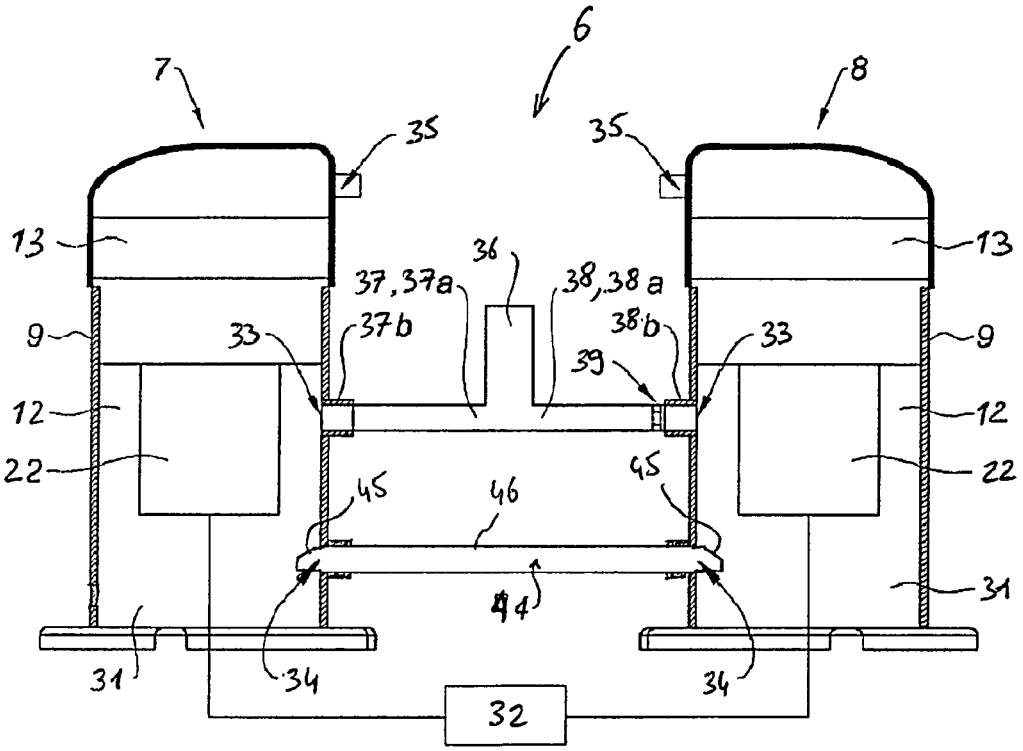
FIG. 7 is a diagrammatic cross-sectional view of a second embodiment of the compression device belonging to the thermodynamic system of FIG. 1.
Figure 8:
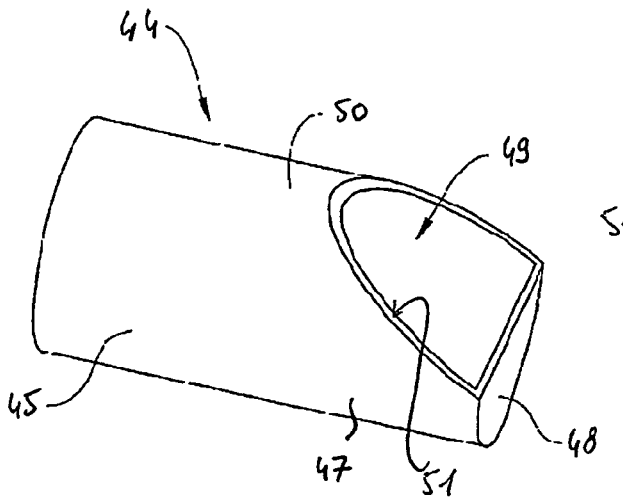
FIGS. 8 and 9 are respectively perspective and top views of an end portion of an oil level equalization pipe of the compression device of FIG. 7.
Figure 9:
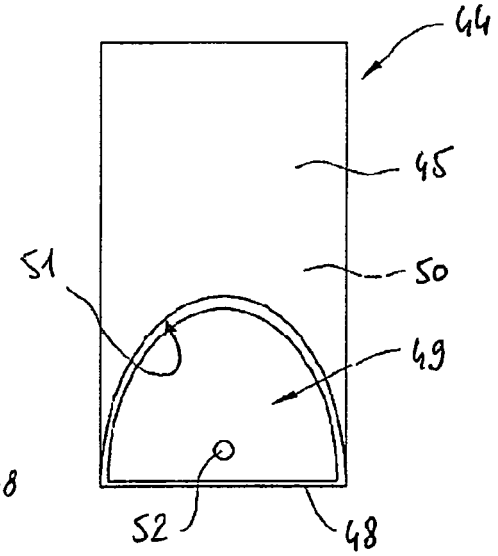

According to a second embodiment of the compression device 6 shown in FIGS. 7 to 9, the connecting portion 46 and the two oil level regulating portions 45 are formed by a same equalization pipe, and each oil return port 52 is formed on the side wall 47 of the corresponding oil level regulating portion 45.

The invention is of course not limited solely to the embodiments of this compression device described above as examples, but on the contrary encompasses all alternative embodiments. Thus in particular, the compression device may comprise more than two compressors mounted in parallel, and for example three or four compressors mounted in parallel.

The invention claimed is:

1. A compression device comprising:

at least one first and one second compressor mounted in parallel and each comprising a sealed enclosure containing a motor, an oil sump and a drive shaft rotatably coupled to the motor, the drive shaft including a lubrication duct configured to be supplied with oil from oil contained in the oil sump, and an oil level equalization line arranged to fluidly connect the oil sumps of the first and second compressors, wherein the oil level equalization line comprises at least one oil level regulating portion positioned near one of the first and second compressors, the oil level regulating portion including a dam wall extending transversely to the longitudinal direction of said oil level regulating portion and a flow opening arranged such that, when the oil level in the oil sump of the compressor situated near the oil level regulating portion extends above the upper level of the dam wall, oil flows through the flow opening toward the other compressor, and the oil level equalization line is arranged and sized such that an upper transfer portion of the equalization line is configured to transfer refrigerant between the first and second compressors, and a lower transfer portion of the equalization line is configured to transfer oil between the first and second compressors, wherein the oil level regulating portion protrudes inside the sealed enclosure of one of the first and second compressors, and wherein the flow opening is inclined relative to the longitudinal direction of the oil level regulating portion.

2. The compression device according to claim 1, wherein the dam wall forms an end wall of the oil level regulating portion.

3. The compression device according to claim 1, wherein the oil level regulating portion includes a flow channel delimited at least partially by the dam wall and fluidly connected to the sealed enclosure of the compressor positioned near the flow opening.

4. The compression device according to claim 1, wherein the sealed enclosure of each compressor includes an equalization port emerging in the corresponding oil sump, and the oil level equalization line includes a tubular connecting portion arranged to fluidly connect the equalization ports of the first and second compressors, the tubular connecting portion being fluidly connected to the oil level regulating portion.

5. The compression device according to claim 4, wherein the passage cross-section of the flow opening is larger than one third of the passage cross-section of the connecting portion.

6. The compression device according to claim 4, wherein the tubular connecting portion is formed by a connecting pipe comprising first and second ends respectively connected to the equalization ports of the first and second compressors, and the oil level regulating portion is formed by an oil level regulating element separate from the connecting pipe.

7. The compression device according to claim 4, wherein the oil level regulating portion and the connecting portion are formed by an equalization pipe.

8. The compression device according to claim 1, wherein the oil level regulating portion includes an oil return port situated below the upper level of the dam wall of the oil level regulating portion.

9. The compression device according to claim 8, wherein the oil return port is formed on the dam wall of the oil level regulating portion.

10. The compression device according to claim 8, wherein each compressor comprises viewing means arranged to make it possible to view the oil level in the oil sump of each compressor through the sealed enclosure thereof, and at least one portion of the oil return port of the oil level regulating portion extends substantially at the same level as the viewing means belonging to each compressor positioned near the oil level regulating portion.

11. The compression device according to claim 1, wherein each compressor comprises oil supply means arranged to supply the lubrication duct of the corresponding drive shaft with oil, the oil supply means comprising an oil input port configured to be connected to the corresponding oil sump and an oil output port connected to the lubrication duct of the drive shaft.

12. The compression device according to claim 8, wherein each compressor comprises oil supply means arranged to supply the lubrication duct of the corresponding drive shaft with oil, the oil supply means comprising an oil input port configured to be connected to the corresponding oil sump and an oil output port connected to the lubrication duct of the drive shaft, and wherein the oil return port of the oil level regulating portion extends above the oil input port of the oil supply means belonging to each compressor positioned near the oil level regulating portion.

13. The compression device according to claim 11, wherein the oil supply means belonging to each compressor comprise an oil pump rotated by the corresponding drive shaft, each oil pump comprising the corresponding oil input and oil output ports.

14. A thermodynamic system, comprising a refrigerant circulation circuit successively including a condenser, an expander, an evaporator and a compression device according to claim 1 connected in series.

15. The compression device according to claim 1, wherein the oil level regulating portion protrudes inside the sealed enclosure of the respective one of the first and second compressors in a horizontal direction.

* * * * *